US006385774B1

(12) United States Patent
Rodgers

(10) Patent No.: US 6,385,774 B1
(45) Date of Patent: May 14, 2002

(54) BIB PRIMARILY FOR DISPOSITION BETWEEN A PERSON AND THEIR SHIRT

(76) Inventor: Carlotta C. Rodgers, 629 Dorchester Rd., Akron, OH (US) 44320

( * ) Notice: Subject to any disclaimer, the term of this patent is extended or adjusted under 35 U.S.C. 154(b) by 0 days.

(21) Appl. No.: 09/815,755

(22) Filed: Mar. 23, 2001

(51) Int. Cl.[7] ..... A41B 13/10; A41D 13/04

(52) U.S. Cl. ..... 2/50; 2/49.1

(58) Field of Search ..... 2/50, 48, 49.1, 2/49.2, 49.4, 46, 60, 51, 52, 468; D2/861, 862

(56) References Cited

U.S. PATENT DOCUMENTS

| | | | | | |
|---|---|---|---|---|---|
| D27,926 | S | | 11/1897 | May | |
| 1,598,838 | A | | 9/1926 | Wilcott | |
| 2,093,483 | A | * | 9/1937 | Sackett | 2/50 |
| 2,110,544 | A | * | 3/1938 | Dauphin | 2/50 |
| 2,174,694 | A | | 10/1939 | Elson | 2/49 |
| 2,199,334 | A | | 4/1940 | Ferry | 2/50 |
| 2,378,380 | A | | 6/1945 | Brown | 2/50 |
| 2,492,599 | A | * | 12/1949 | Smith | 2/49 |
| 2,523,565 | A | * | 9/1950 | Gardner | 2/49 |
| 2,544,487 | A | * | 3/1951 | Caluthis | 2/50 |
| 2,622,246 | A | * | 12/1952 | Hufnagel | 2/49 |
| 2,703,426 | A | | 3/1955 | Barkl | 15/257 |
| 2,947,004 | A | * | 8/1960 | Pfile | 2/50 |
| 3,857,116 | A | * | 12/1974 | Meeker | 2/50 |
| 3,884,355 | A | | 5/1975 | Eriksson | 206/494 |
| 3,945,048 | A | * | 3/1976 | Shearer | 2/49 R |
| 3,996,946 | A | | 12/1976 | Craig | 132/9 |
| 4,302,046 | A | | 11/1981 | Lazazzero | 297/191 |
| 4,442,552 | A | * | 4/1984 | Bolick et al. | 2/49 R |
| 4,458,364 | A | | 7/1984 | Fenninger et al. | 2/90 |
| 5,146,629 | A | | 9/1992 | Barnes | 2/174 |
| D358,731 | S | | 5/1995 | McAlear | D6/513 |
| D369,498 | S | | 5/1996 | Newcomb | D6/513 |
| 5,651,140 | A | * | 7/1997 | Gibson | 2/46 |
| 5,809,568 | A | * | 9/1998 | Morris-Jones | 2/49.1 |
| 5,930,836 | A | * | 8/1999 | Morris | 2/49.1 |
| 5,950,236 | A | | 9/1999 | Andrew et al. | 2/50 |
| 5,953,753 | A | * | 9/1999 | Perez | 2/50 |
| 5,956,761 | A | * | 9/1999 | Capnerhurst | 2/50 |
| 5,956,763 | A | * | 9/1999 | Blackshear | 2/50 |
| 5,991,919 | A | * | 11/1999 | Baggetto | 2/50 |
| 6,094,744 | A | * | 8/2000 | Dibenedetto et al. | 2/50 |

* cited by examiner

*Primary Examiner*—Amy B. Vanatta
(74) *Attorney, Agent, or Firm*—Renner, Kenner, Greive, Bobak, Taylor & Weber

(57) ABSTRACT

A bib positionable on a person's torso includes a back portion, a neck portion extending from the back portion, a strap extending substantially perpendicularly from the neck portion, and a collar flap extending from the neck portion, the collar flap foldable with respect to the neck portion to facilitate securement of the bib to the person's torso.

9 Claims, 3 Drawing Sheets

FIG.-3
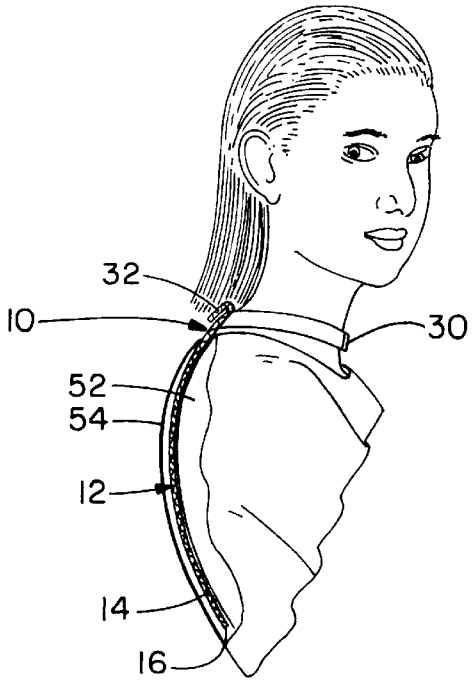
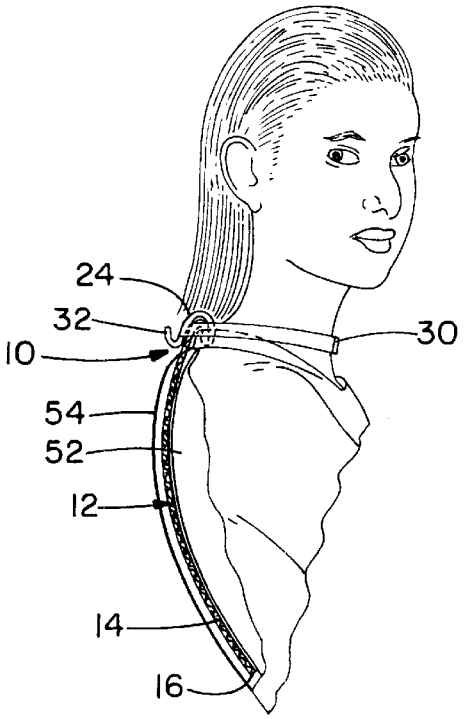
FIG.-3A
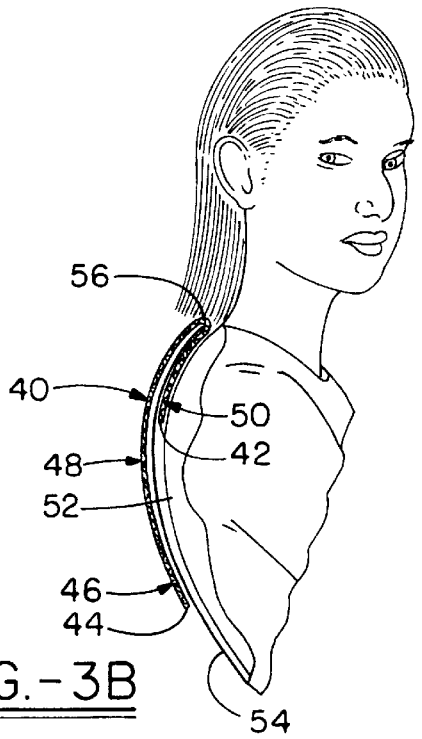
FIG.-3B

BIB PRIMARILY FOR DISPOSITION BETWEEN A PERSON AND THEIR SHIRT

TECHNICAL FIELD

The invention herein resides generally in the art of bibs or personal covering devices. More particularly, the present invention relates to bibs for keeping moisture away from a person's skin and clothing. Specifically, the present invention relates to bibs which provide features to assist in securing the bib to a person's torso.

BACKGROUND ART

It is well known in the art to use bibs for protecting clothing while a person eats or is having their hair washed prior to cutting. Known bibs cover clothing so that any food that is spilled or inadvertently dropped falls on the bib and not on the person's clothing. This protects the clothing from a short term appearance problem and, more importantly, protects the clothing from permanent staining.

In beauty salons, it is also known to use bibs in a somewhat similar fashion. Prior to having one's hair cut, a person's hair may be washed by a stylist. In this case, the person sits in a type of reclining chair and tilts their head back while the stylist washes their hair in a sink. At this time, the stylist may apply coloring or other chemical-type treatments to the hair, depending upon the hair style desired. In any event, once the washing and/or treatment is complete, the person sits up and the hair falls on the bib where it is either absorbed by the bib or repelled. But, moisture retained by the hair and scalp region tends to trickle down the person's neck and migrate along their skin underneath the bib. This moisture, at the least, causes discomfort to the customer and, at worst, damages the customer's clothing. The water may also spill on the floor causing a safety hazard.

Bibs are also known to provide neck straps to help secure the bib to the person's neck and to hold the bib in place over the person's torso. However, this is still found to be inadequate in absorbing moisture that trickles down from the person's scalp. It is also believed that known bibs are inadequate in construction in that some only repel water, but none efficiently or effectively absorb water when needed or effectively absorb water from one side while also repelling water from an opposite side.

Based upon the foregoing, it is evident that there is a need in the art for an improved bib construction.

DISCLOSURE OF INVENTION

It is thus an aspect of the present invention to provide a bib.

It is another aspect of the present invention to provide the bib so that it is positionable either on the person over their shirt, or between the shirt and the person and wherein the bib has a back portion and a neck portion.

It is a further aspect of the present invention to provide the bib, as set forth above, with a neck portion with an extending neck strap, wherein the neck portion may be folded over or not, and wherein the neck strap is tied around the person's neck to further secure the bib to the person.

It is yet another aspect of the present invention to provide the bib, as set forth above, wherein a collar flap extends from the neck portion and is foldable in either direction with respect thereto, wherein the collar flap assists in securing the bib to the person.

The foregoing and other aspects of the present invention, which shall become apparent as the detailed description proceeds, are achieved by a bib positionable on a person's torso, comprising a back portion, a neck portion extending from the back portion, a strap extending substantially perpendicularly from the neck portion, and a collar flap extending from the neck portion, the collar flap foldable with respect to the neck portion to facilitate securement of the bib to the person's torso.

Other aspects of the present invention are attained by a bib positionable between a shirt and person's torso wearing the shirt, comprising a back portion having a bottom edge, a shoulder taper extending from the back portion, and a neck portion extending from the shoulder taper, the neck portion having a top edge opposite the bottom edge, wherein either the back portion or the neck portion is positionable between the shirt and the person's torso while the other is folded over the shirt.

Still another aspect of the present invention is attained by a method for positioning a bib on a person wearing a shirt, comprising providing a bib having a back portion with a bottom edge, and the bib having a neck portion extending from the shoulder taper, the neck portion having a top edge opposite the bottom edge, inserting the neck portion between the person and the shirt, and folding the back portion over the shirt.

These and other aspects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein:

FIGS. 3, 3A, and 3B are side elevational views in partial cross-section showing the bib disposed between the person's torso and their shirt;

BEST MODE FOR CARRYING OUT THE INVENTION

Figure 1:
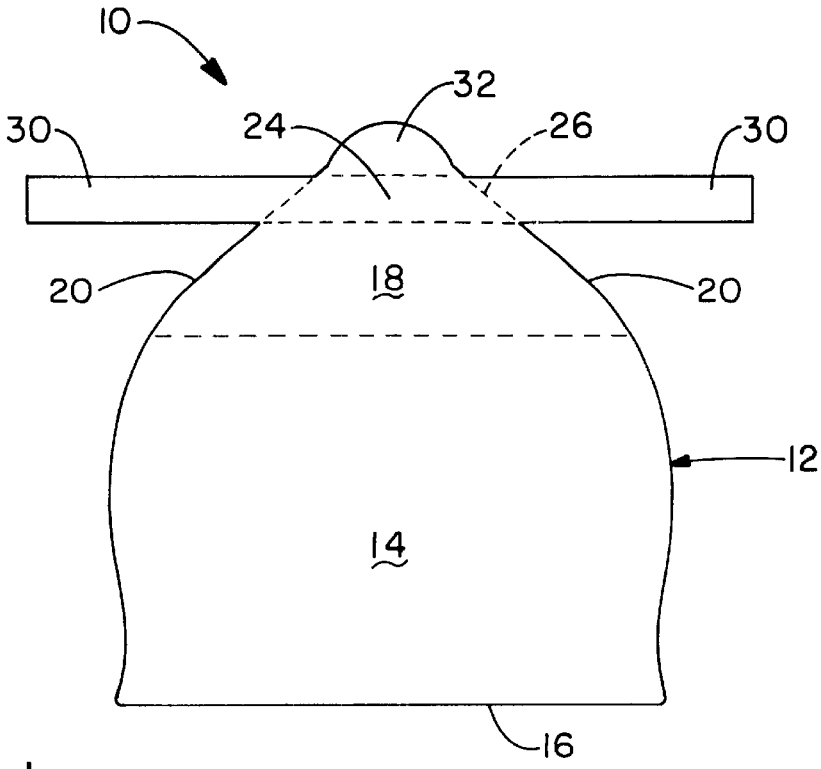
FIG. 1 is a plan view illustrating a bib according to the present invention.

Referring now to the drawings and, in particular, to FIGS. 1, 3, and 3A, it can be seen that a bib, according to the present invention, is designated generally by the numeral 10. As will become apparent from the description, the bib may be used in any number of settings and may be disposed upon a person's back torso or front torso. Moreover, the bib may be inserted between the person's torso and their shirt front or their shirt back. The primary purpose of the bib is to absorb water or other moisture-laden materials so as to keep the person wearing the bib dry and to avoid any damage to their clothing.

The bib 10 includes a torso portion 12 which includes a lower section 14 and a bottom edge 16. Extending from the lower section 14, in a direction opposite the bottom edge 16, is a taper section 18 that has a curvilinear edge 20 extending from both sides of the section 14. Extending further from the taper section 18 is a neck 24. The neck also provides an edge 26 that extends from the edges 20. It will be appreciated that the dashed lines shown in FIG. I delineate the different sections described above.

A strap 30 extends from each edge 26 in a substantially perpendicular orientation. Although the straps are shown extending from both edges 26, it will be appreciated that only one strap may be provided extending from one edge 26. Extending further from the top edge of the neck 24 is a collar flap 32 that is foldable at the dashed line delineating the collar flap from the neck 24. Placement and orientation of the bib 10 on a person will be described below.

Figure 2:
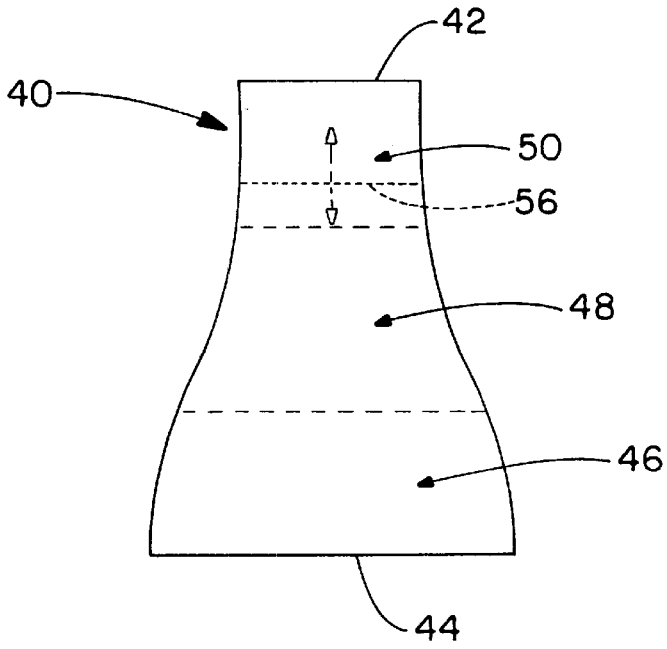
FIG. 2 is a plan view of a bib according to another embodiment of the present invention.

Referring now to FIG. 2, it can be seen that a bib, designated generally by the numeral 40, is shown. The bib 40 includes a top edge 42 and a bottom edge 44. Disposed between the top edge 42 and the bottom edge 44 is a back portion 46 that extends into a shoulder taper section 48. Extending further from the shoulder taper section 48 is a neck portion 50. It will be appreciated that the back portion 46 is wider than the shoulder taper 48 which is angled so as to curvilinearly extend into the neck portion 50. Accordingly, the neck portion 50 is substantially narrower than the back portion 46.

Referring now to FIG. 3, use of the bibs 10 and 40 will be discussed. FIG. 3 shows a person's torso 52, wherein that person is wearing a shirt 54. Although the torso shown in FIG. 3 shows the bibs 10 and 40 disposed on a person's back, it will be appreciated by those skilled in the art that the present teaching is equally applicable to securing the bibs to a person's chest.

When it is desired to use the bib 10, the stylist loosens the person's top button and/or shirt and inserts the lower section 14 between the shirt and the person's torso. The stylist will take care to ensure that the back portion 12 lays essentially flat on the person's back. Once the back portion is properly positioned, the stylist may position the neck 24 around the person's neck and overlap the neck straps so that the bib is held securely in place. Then, the stylist may fold the collar flap 32 over the person's shirt and/or shirt collar. Folding of the collar flap may be done prior to tying of the neck straps. It will be appreciated that a separate drape or bib may be applied over the person's shirt prior to the folding of the collar flap 32. In any event, after the person's hair has been washed, any moisture accumulating on the scalp is likely directed down the back of the person's neck and will be absorbed by the neck portion 24, neck straps 30 and/or the taper section 18. Alternatively, as seen in FIG. 3A, a bib may be positioned such that the neck strap extends above the person's collar to allow for folding the neck 24 over the person's collar. The neck straps 30 are then tied around as described above. Alternatively, the straps could be provided with hook and loop fasteners, snaps or buttons to facilitate securement of the straps. At this time, the collar flap 32 may be folded upwardly against the neck 24. It has been found that by folding over the collar flap 32 in either embodiment described above, that the neck straps are less likely to become loosened during wearing of the bib 10.

Installation of the bib 40 is accomplished in a similar manner as seen in FIG. 3B. The stylist will loosen the person's shirt and then insert the neck portion 50 between the person's back and shirt. When the neck portion 50 no longer fits comfortably between the person's shirt and back, the stylist will fold, for example, at a fold line 56, the uninserted portion over so that it covers the person's shirt. The position of the fold line 56 is dependent upon the size of the person's neck. It will be appreciated that installation of this bib 40 is much easier than the bib 10 while providing many of the same benefits.

Figure 4:
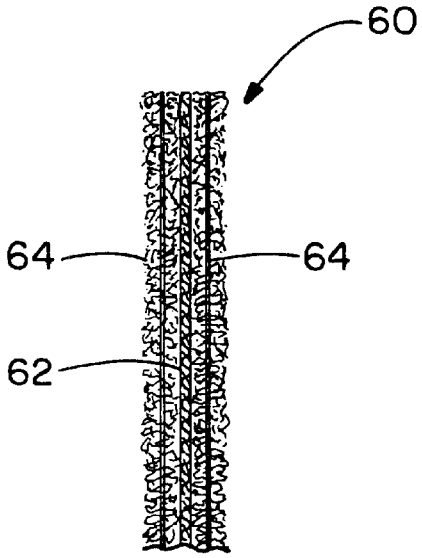
FIG. 4 is a cross-sectional view of a bib construction material.
Figure 5:
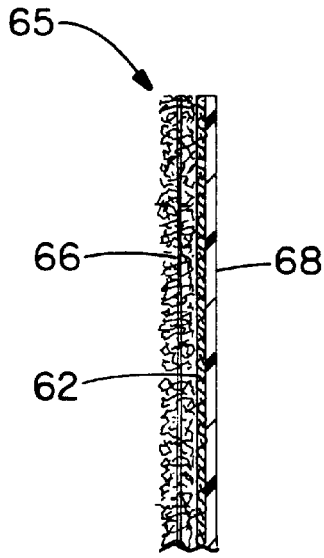
FIG. 5 is a cross-sectional view of an alternative bib construction material.

Referring now to FIGS. 4 and 5, the construction of the material which is used in either the bib 10 or 40 is disclosed. As best seen in FIG. 4, the bib construction, designated generally by the numeral 60, includes a base material 62 which is absorbent and sponge-like inasmuch as it holds water without allowing the water to escape until fully saturated. Disposed on either side of the base material 62 is an absorbing outer layer 64. Accordingly, with this construction, if moisture is applied to either absorbing layer 64, it is absorbed and transferred into the base material 52. Accordingly, any moisture or other materials absorbed are contained within the base material 62 until such tie that the absorbing outer layer is completely dry and then the moisture evaporates in a normal manner.

Referring now to FIG. 5, an alternative construction to the bib material is designated generally by the numeral 65. The material 65 includes a base material 62 as in the previous embodiment. In this instance, one absorbing layer 66 is provided on one side of the base material 62 while the opposite side is covered with a repellant outer material 68. This construction has the advantage of repelling any water before it enters the base material.

In view of the foregoing, it should thus be evident that a bib constructed and used as described herein accomplishes the objects of the present invention and otherwise substantially improves the art. Moreover, the advantages of the present invention are readily apparent to one skilled in the art. By providing a collar flap 32, the securement of the bib is further enhanced while also providing an additional surfaces for absorbing extraneous moisture after a person has had their hair washed. This keeps moisture off of the person's shirt and from collecting on the floor. The collar flap also contains the securement of the neck straps 30 such that they are not easily loosened until the collar flap is unfolded. The bib 40 is advantageous inasmuch it is easily installed and does not require typing of the straps 30.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of true scope and breadth of the invention, reference should be made to the following claims.

What is claimed is:

1. A bib positionable on a person's torso, comprising:

a back portion having a top edge;

a neck portion extending from said top edge of said back portion, said neck portion foldable with respect to said back portion;

a strap extending substantially perpendicularly from only said neck portion so that said strap has a length greater than a width of said back portion; and a collar flap extending from only said neck portion at a side opposite said back portion, said collar flap foldable with respect to said neck portion to facilitate securement of the bib to the person's torso.

2. The bib according to claim 1, wherein said neck has opposed side edges, and wherein said strap extends substantially perpendicularly from both said side edges.

3. The bib according to claim 1, wherein said back portion comprises:

a lower section; and a taper section positioned between said lower section and said neck, said taper section being wider at said lower section.

4. The bib according to claim 1, wherein said back portion and said neck portion are constructed of a material which comprises:

a base material that absorbs and holds moisture; and at least one absorbent facing material that absorbs moisture and passes the moisture through to said base material.

5. The bib according to claim 4, further comprising:

another absorbent facing material that absorbs moisture placed on an opposite side of said base material.

6. The bib according to claim 4, further comprising:

a moisture repellant facing material placed on an opposite side of said base material.

7. A method for positioning a bib on a person wearing a shirt, comprising:

providing a bib having a back portion with a bottom edge, and said bib having a neck portion extending from said back portion, said neck portion having a top edge opposite said bottom edge;

inserting said back portion between the person and the shirt;

folding said neck portion over the shirt; providing said bib with a strap extending substantially perpendicularly from said neck portion; and tying said strap around the person's neck.

8. The method according to claim 7, further comprising:

providing said neck portion with a width narrower than said back portion.

9. The method according to claim 7, further comprising:

providing said bib with a collar flap extending from said top edge; and folding said collar flap back over said neck portion prior to said tying step.

* * * * *